US009057487B2

(12) United States Patent
Chen

(10) Patent No.: US 9,057,487 B2
(45) Date of Patent: Jun. 16, 2015

(54) ELECTRONIC INCENSE CENSER

(71) Applicant: HON HAI PRECISION INDUSTRY CO., LTD., New Taipei (TW)

(72) Inventor: Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 58 days.

(21) Appl. No.: 14/018,426

(22) Filed: Sep. 5, 2013

(65) Prior Publication Data

US 2014/0177265 A1 Jun. 26, 2014

(30) Foreign Application Priority Data

Dec. 26, 2012 (TW) ..... 101150291 A

(51) Int. Cl.
*F21K 99/00* (2010.01)
*F21S 6/00* (2006.01)
*F21S 10/04* (2006.01)

(52) U.S. Cl.
CPC . *F21K 9/52* (2013.01); *F21S 6/001* (2013.01); *F21S 10/043* (2013.01)

(58) Field of Classification Search
USPC ..... 362/565, 555
See application file for complete search history.

(56) References Cited

U.S. PATENT DOCUMENTS

| | | | | |
|---|---|---|---|---|
| 3,644,725 | A * | 2/1972 | Lochridge, Jr. | 362/556 |
| 6,817,745 | B2 * | 11/2004 | Leung et al. | 362/555 |
| 7,575,356 | B1 * | 8/2009 | Bouchard | 362/571 |
| 8,313,225 | B1 * | 11/2012 | Chen | 362/565 |
| 2008/0043461 | A1 * | 2/2008 | Xiao | 362/161 |
| 2012/0106154 | A1 * | 5/2012 | Chang | 362/249.02 |
| 2013/0163275 | A1 * | 6/2013 | Chen | 362/562 |

* cited by examiner

*Primary Examiner* — Laura Tso
(74) *Attorney, Agent, or Firm* — Novak Druce Connolly Bove + Quigg LLP

(57) ABSTRACT

An electronic incense censer includes an electronic incense which consists of a light guide for guiding light and a sheath coated on a circumferential periphery of the light guide, a light source arranged at a light incident end of the light guide, and a light emitting portion arranged at a light output end of the light guide. A color of light generated by the light source is adjustable by mixing light beams having different colors, wherein intensities of the light beams are adjustable. The light enters the light guide via the light incident end and reaches the light emitting portion via a guidance of the light guide.

10 Claims, 1 Drawing Sheet

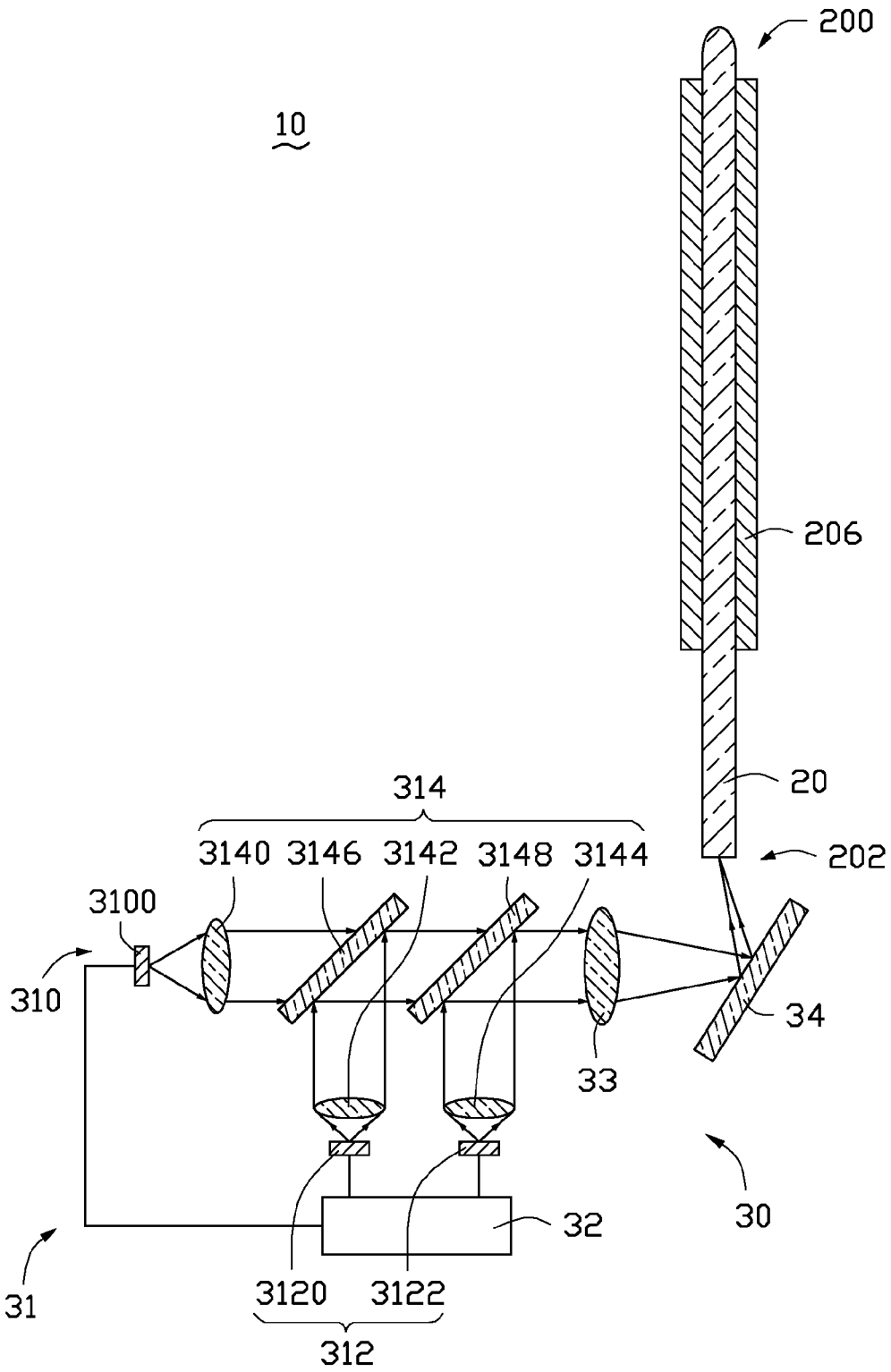
200
10
206
20
314
3140
3146
3142
3148
3144
202
3100
310
34
33
30
32
31
3120
3122
312

ELECTRONIC INCENSE CENSER

BACKGROUND

1. Technical Field

The present disclosure generally relates to an incense censer, and particularly to an electronic incense censer whose incense can generate different color effects of a burning incense.

2. Description of the Related Art

A traditional incense mainly includes a rod made of bamboo and aromatic biotic materials coated on the rod. The incense is accommodated in an incense censer. When the aromatic biotic materials are burned, they release a large amount of smoke. The burning incense could ignite other articles to burn which may cause fire; furthermore, the released smoke not only pollutes the environment, but also is harmful to human health.

Accordingly, an electronic incense is used to replace the traditional incense. The electronic incense consists of a rod made of optical fibers and an opaque sheath coated on a circumferential periphery of the rod. The sheath has a color similar to that of the aromatic biotic materials to stimulate the appearance of the traditional incense. A red light emitting diode (LED) is arranged on a bottom of the rod. The rod absorbs red light emitting from the red LED and transfers the red light to a top end of the rod, from which the red light radiates to simulate the burning top end of the traditional incense. However, the electronic incense with a single color of luminance is not visually attractive enough and can not satisfy some special occasions which may need the luminance of the electronic incense to be other color.

Therefore, it is desirable to provide an electronic incense censer having at least an electronic incense which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present electronic incense censer. Moreover, in the drawings, all the views are schematic, and like reference numerals designate corresponding parts throughout the views.

The single drawing is a cross-sectional view of an electronic incense censer in accordance with an exemplary embodiment of the present disclosure.

DETAILED DESCRIPTION

Referring to the drawing, an electronic incense censer 10 includes a light guide 20 and a light source 30.

The light guide 20 is cylindrical. The light guide 20 includes a top end 200 for radiating light and a bottom end 202 for absorbing light from the light source 30 thereinto. The light guide 20 is made of optical fiber which can guide the light from the bottom end 202 to the top end 200. Preferably, a surface of the top end 200 is atomized so that light radiating out from the surface of the top end 200 can be diverged to different orientations for simulating the traditional burning incense.

A sheath 206 is coated on a main portion of a circumferential periphery of the light guide 20 to form an electronic incense. In this embodiment, a color of the sheath 206 is the same as that of the aromatic biotic materials of the traditional incense. A reflective material for avoiding light from losing may be coated on the circumferential periphery of the light guide 20 before the sheath 206 is coated thereon.

The light source 30 is arranged below the bottom end 202 of the light guide 20. The light source 30 includes a light mixing module 31 and a light regulating module 32. The light mixing module 31 generates mixed light beams and transfers the light beams to the bottom end 202 of the light guide 20. The light regulating module 32 is electrically connected to the light mixing module 31 to regulate colors of the mixed light beams generated by the light mixing module 31.

The light mixing module 31 includes a primary color light source 310, a mixed color light source 312 and a light collector 314. The light collector 314 collects and mixes light from the primary color light source 310 and the mixed color light source 312, and thereafter transfers the mixed light to the bottom end 202 of the light guide 20. The light regulating module 32 electrically connects the primary color light source 310 and the mixed color light source 312 for controlling electrical parameters thereof. At least one of the primary color light source 310 and the mixed color light source 312 is a light emitting diode (LED).

In this embodiment, the primary color light source 310 includes a first color luminant 3100. The mixed color light source 312 includes a second color luminant 3120 and a third color luminant 3122. The light collector 314 collects and mixes light of three colors respectively from the first color luminant 3100, the second color luminant 3120 and the third color luminant 3122, and thereafter transfers the mixed light to the bottom end 202 of the light guide 20. In this embodiment, the first color luminant 3100 is a green LED, the second color luminant 3120 is a red LED, and the third color luminant 3122 is a blue LED. The light regulating module 32 electrically connects with the first color luminant 3100, the second color luminant 3120, and the third color luminant 3122 to control electrical parameters thereof. Correspondingly, the light regulating module 32 controls a brightness of the first color luminant 3100, a brightness of the second color luminant 3120 and a brightness of the third color luminant 3122 by regulating amounts of electrical current flowing to the first, second and third color luminants 3100, 3120, 3122, respectively. A color of an output of the light radiating out from the top end 200 is adjustable according to the adjustment of the different brightness of the three luminants 3100, 3120, 3122.

In this embodiment, the light regulating module 32 may be a driving circuit of the first color luminant 3100, the second color luminant 3120 and the third color luminant 3122.

The light collector 314 includes a first light concentrating lens 3140, a second light concentrating lens 3142, a third light concentrating lens 3144, a first color separation sheet 3146, and a second color separation sheet 3148. Specifically, the first light concentrating lens 3140 is arranged on a light outputting path of the first color luminant 3100. The second light concentrating lens 3142 is arranged on a light outputting path of the second color luminant 3120. The third light concentrating lens 3144 is arranged on a light outputting path of the third color luminant 3122. The first color separation sheet 3146 is arranged on a light outputting side of the first light concentrating lens 3140 and the second light concentrating lens 3142. The second color separation sheet 3148 is arranged on a light outputting side of the third light concentrating lens 3144.

Light from the first color luminant 3100, the second color luminant 3120 and the third color luminant 3122 is respectively adjusted to form corresponding parallel light beam by the first light concentrating lens 3140, the second light concentrating lens 3142 and the third light concentrating lens

3144. The parallel light beam from the second light concentrating lens 3142 and the parallel light beam from the third light concentrating lens 3144 are respectively reflected by the first color separation sheet 3146 and the second color separation sheet 3148 to be parallel with the parallel light beam from the first light concentrating lens 3140. The parallel light beams are mixed to form a mixed color light beam which enters the light guide 20 from the bottom end 202.

Preferably, the light source 30 further includes a light concentrating module 33. The mixed color light beam from the light mixing module 31 is regulated to form a mixed color light beam with a preset size. The light concentrating module 33 may be a light concentrating lens. Since the mixed color light beam from the light mixing module 31 may be regulated by the light concentrating module 33 to have a variable size, the light guide 20 can have a variable diameter whereby the electronic incense can have a variable diameter to meet different requirements.

Preferably, the light source 30 further includes a reflective module 34. The mixed color light beam with preset size from the light concentrating module 30 is reflected to the bottom end 202 of the light guide 20 by the reflective module 34. Accordingly, the light source 30 may be arranged at any suitable place to increase the versatility of the electronic incense censer 10. The reflective module 34 may be a reflective lens.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. An electronic incense censer comprising:

a light guide for guiding light;

a sheath coated on a circumferential periphery of the light guide to combine therewith to form an electronic incense;

a light source arranged at a light incident end of the light guide, a color of light generated by the light source being adjustable; and a light emitting portion arranged at a light output end of the light guide for radiating the light generated by the light source which emits into the light guide from the light incident end thereof to reach light emitting portion via a guidance of the light guide;

wherein the light source comprises a light mixing module and a light regulating module, the light generated by the light source comprising mixed light beams generated by the light mixing module, the light regulating module electrically connecting with the light mixing module to adjust the color of the light generated by the light source which comprises the mixed light beams generated by the light mixing module;

wherein the light mixing module comprises a primary color light source, a mixed color light source and a light collector, the light collector collecting and mixing light from the primary color light source and the mixed color light source to form the mixed light beams, the light collector transferring the mixed light beams to the incident end of the light guide, the light regulating module electrically connecting with the primary color light source and the mixed color light source to control electrical parameters of the primary color light source and the mixed color light source, respectively.

2. The electronic incense censer of claim 1, wherein at least one of the primary color light source and the mixed color light source is a light emitting diode (LED).

3. The electronic incense censer of claim 1, wherein the primary color light source comprises a first color luminant, the mixed color light source comprising a second color luminant and a third color luminant, the light collector collecting and mixing light from the first color luminant, the second color luminant and the third color luminant to form the mixed light beams, the light regulating module electrically connecting with the first color luminant, the second color luminant and the third color luminant to control electrical parameters of the first color luminant, the second color luminant and the third color luminant, respectively.

4. The electronic incense censer of claim 3, wherein the light collector comprises a first light concentrating lens, a second light concentrating lens, a third light concentrating lens, a first color separation sheet and a second color separation sheet, the first light concentrating lens being arranged on a light outputting path of the first light luminant, the second light concentrating lens being arranged on a light outputting path of the second color luminant, the third light concentrating lens being arranged on a light outputting path of the third color luminant, light from the first color luminant, the second color luminant and the third color luminant being respectively adjusted to form corresponding parallel light beam by the first light concentrating lens, the second light concentrating lens and the third light concentrating lens, the parallel light beam from the second light concentrating lens and the parallel light beam from the third light concentrating lens being respectively reflected by the first color separation sheet and the second color separation sheet to be parallel with the parallel light beam from the first light concentrating lens.

5. The electronic incense censer of claim 1, wherein the light source further comprises a light concentrating module, the mixed light beams from the light mixing module being regulated by the light concentrating module to have a preset size.

6. The electronic incense censer of claim 5, wherein the light concentrating module is a light concentrating lens.

7. The electronic incense censer of claim 5, wherein the light source further comprises a reflective module, the mixed light beams with a preset size from the light concentrating module being reflected by the reflective module to reach the incident end of the light guide.

8. The electronic incense censer of claim 7, wherein the reflective module is a reflective lens.

9. The electronic incense censer of claim 1, wherein the electrical parameters include amounts of electrical current.

10. The electronic incense censer of claim 3, wherein the electrical parameters include amounts of electrical current.

* * * * *